US007587976B2

(12) United States Patent
Chang et al.

(10) Patent No.: US 7,587,976 B2
(45) Date of Patent: Sep. 15, 2009

(54) PRINTING APPARATUS HAVING FIXING MECHANISM INCLUDING AIR PIPE ASSEMBLY

(75) Inventors: Chia-Hsing Chang, Taipei Hsien (TW); Jia-Wu Xiong, Shenzhen (CN); Hui Meng, Shenzhen (CN); Qin Liu, Shenzhen (CN); Hong-Peng Ma, Shenzhen (CN); Li-Bing Deng, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 11/964,815

(22) Filed: Dec. 27, 2007

(65) Prior Publication Data

US 2009/0064878 A1 Mar. 12, 2009

(30) Foreign Application Priority Data

Sep. 11, 2007 (CN) ..... 2007 1 0201656

(51) Int. Cl.
*B41F 15/20* (2006.01)

(52) U.S. Cl. ..... 101/126; 101/114; 101/474

(58) Field of Classification Search ..... 101/126; *B41F 15/20*

See application file for complete search history.

(56) References Cited

U.S. PATENT DOCUMENTS 4,463,673 A * 8/1984 Moore ..... 101/129
4,729,306 A * 3/1988 Bubley ..... 101/114

* cited by examiner

*Primary Examiner*—Leslie J Evanisko
(74) *Attorney, Agent, or Firm*—Steven M. Reiss

(57) ABSTRACT

A fixing mechanism (2) includes a base (50), an air pump (70) and an air pipe assembly (60). The base defining a connecting hole (522) and a locating groove (542) therein. The air pipe assembly (60) includes a first pipe (62) communicating with the connecting hole, a second pipe (64) connected to the pump and communicating with the first pipe, and a third pipe (66) communicating with the first pipe and the second pipe.

8 Claims, 4 Drawing Sheets

PRINTING APPARATUS HAVING FIXING MECHANISM INCLUDING AIR PIPE ASSEMBLY

BACKGROUND OF THE INVENTION

1. Field of the Invention

The present invention generally relates to printing, and particularly to a printing apparatus comprising a fixing mechanism.

2. Description of Related Art

Nowadays, printing mainly includes silk-screen printing, relief printing, planographic printing, gravure printing, etc. Compared to other printing methods, silk-screen printing is more popular because of its facility and cheapness.

In the method of silk-screen printing, first, a silk-screen having a large number of meshes is woven to cover the printing objects. Sensitive glue is spread on the silk-screen to block the meshes and forms a sensitive layer on the silk-screen. A negative having predetermined designs/characters is covered on the silk-screen, and the silk-screen and the negative are exposed together. Thus, the sensitive layer of the silk-screen is exposed and solidified except the part covered by the designs/characters of the negative. The silk-screen is then washed, the solidified part of the sensitive layer remains on the silk-screen while the part covered by the designs/characters of the negative is removed. In this way, the meshes corresponding to the designs/characters of the negative are opened again, and the silk-screen is completed.

In use, the silk-screen covers a printing object, and ink is spread on the silk-screen. The ink passes the open meshes and adheres to the object, thus the designs/characters of the negative is formed on the object. The silk-screen is then removed after printing, thus the printing operation is completed.

In the aforementioned method, since the ink has glutinosity, the object can be glued to the silk-screen in printing. Thus, the object may be moved or damaged when the silk-screen is removed, and the printing quality is then decreased. In a typical printing method, the object is fixed on a worktable via glue. The glue has higher glutinosity than that of the ink, thus prevents the object from being moved by the silk-screen. However, additional cost is required for the glue and it is difficult to remove the glue after printing. Thus, productive efficiency is decreased.

Therefore, a fixing mechanism used to print and a new printing apparatus are desired in order to overcome the above-described shortcomings.

SUMMARY OF THE INVENTION

A fixing mechanism includes a base, an air pump and an air pipe assembly. The base defining a connecting hole and a locating groove therein. The air pipe assembly includes a first pipe communicating with the connecting hole, a second pipe connected to the pump and communicating with the first pipe, and a third pipe communicating with the first pipe and the second pipe.

A printing apparatus includes a worktable, a silk-screen and a fixing mechanism. The worktable includes a base, a bracket and a post. One end of the silk-screen is rotatably connected to the bracket and another end of the silk-screen is held by the post. The fixing mechanism includes a base, a pump and an air pipe assembly, the air pipe assembly includes a first pipe communicating with the base, a second pipe connected to the pump and communicating with the first pipe, and a third pipe communicating with the first pipe and the second pipe.

Other novel features will become more apparent from the following detailed description when taken in conjunction with the accompanying drawings.

BRIEF DESCRIPTION OF THE DRAWINGS

Many aspects of the fixing mechanism and the printing apparatus can be better understood with reference to the following drawings. The components in the drawings are not necessarily drawn to scale, the emphasis instead being placed upon clearly illustrating the principles of the fixing mechanism and the printing apparatus. Moreover, in the drawings, like reference numerals designate corresponding parts throughout the several views.

DETAILED DESCRIPTION OF THE INVENTION

Figure 1:
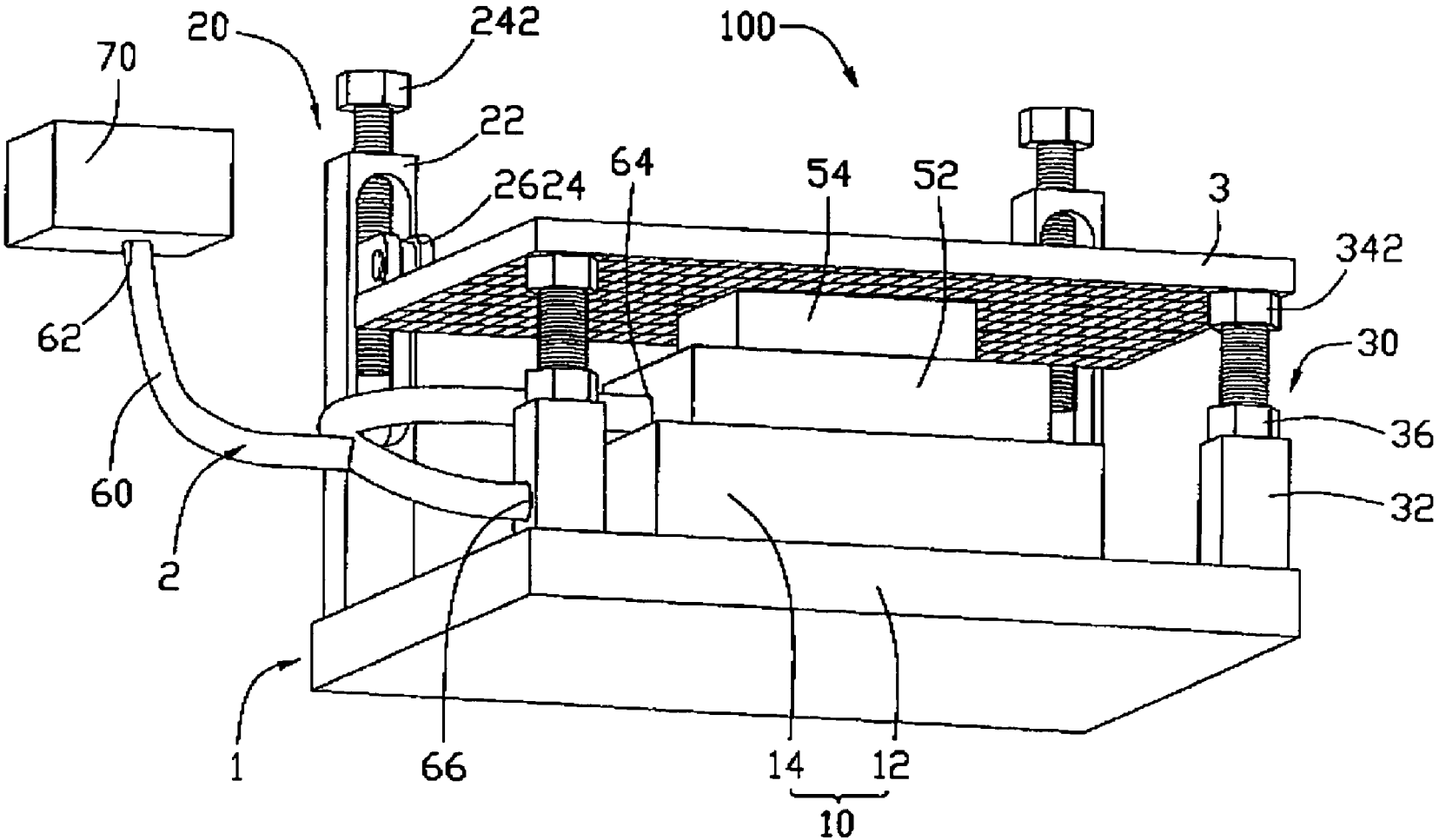
FIG. 1 is a schematic view of a printing apparatus in accordance with a present embodiment.

Referring to FIG. 1, a printing apparatus 100 in accordance with a present embodiment is provided. The printing apparatus 100 includes a worktable 1, a fixing mechanism 2 mounted on the worktable 1 and a silk-screen 3 rotatably mounted on the worktable 1.

The worktable 1 includes a base 10, two brackets 20 and two posts 30. The base 10 includes an approximately rectangular bottom board 12 and an approximately rectangular carrying board 14 located on a central portion of the bottom board 12. The carrying board 14 defines a plurality of first locating holes (not shown) therein. The brackets 20 and the posts 30 are respectively fixed on four corners of the bottom board 12.

Figure 2:
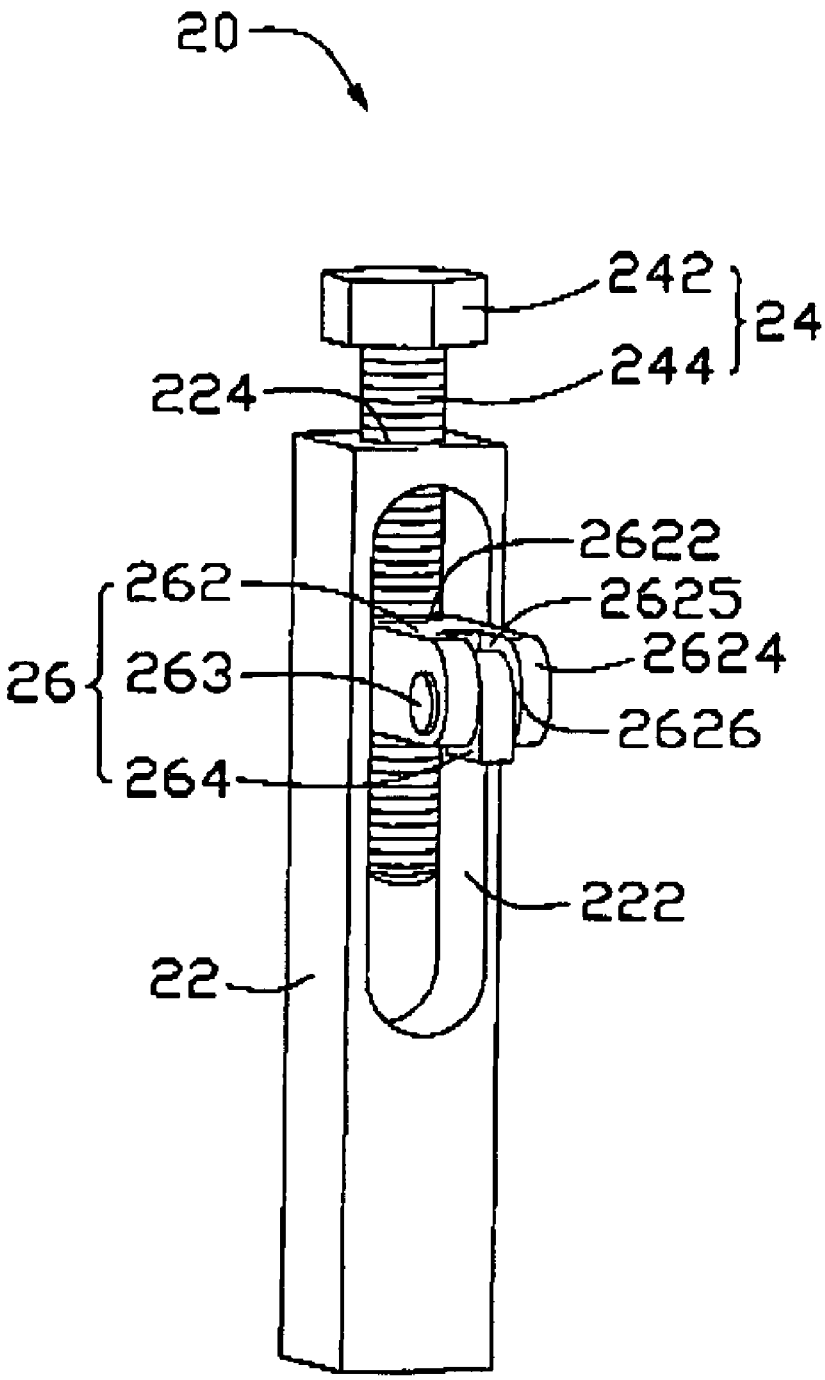
FIG. 2 is an enlarged view of a bracket of the printing apparatus shown in FIG. 1.

Also referring to FIG. 2, each bracket 20 includes a prism member 22, a first bolt 24 and a hinge assembly 26. The prism member 22 defines an adjusting aperture 222 in its side portion and a first thread hole 224 in its top portion. The first thread hole 224 runs along an axis of the prism member 22 and communicates with the adjusting aperture 222. The first bolt 24 includes a first head portion 242 for adjusting its position and a first thread portion 244 corresponding to the first thread hole 224.

The hinge assembly 26 includes a mounting member 262, an axle 263 and a hanging member 264. The mounting member 262 includes a screw end 2622 and a hinge end 2624 opposite to the screw end 2622. The screw end 2622 defines a second thread hole (not labeled) configured for receiving the thread portion 244 therein. The hinge end 2624 defines a containing groove 2625, and two walls 2626 corresponding to the containing groove 2625 are formed at the hinge end 2624. Each wall 2626 defines a first axle hole (not labeled) corresponding to the axle 263 therethrough. The hanging member 264 is a triangular prism defining a second axle hole (not labeled) corresponding to the first axle holes.

In the assembly process of the bracket 20, the axle 263 is inserted into the first axle holes and the second axle hole to mount the hanging member 264 to the mounting member 262. The thread portion 244 is screwed into the first thread hole 224 and the second thread hole of the screw end 2622, thus the hinge assembly 26 is movably mounted on the first bolt 24.

Figure 3:
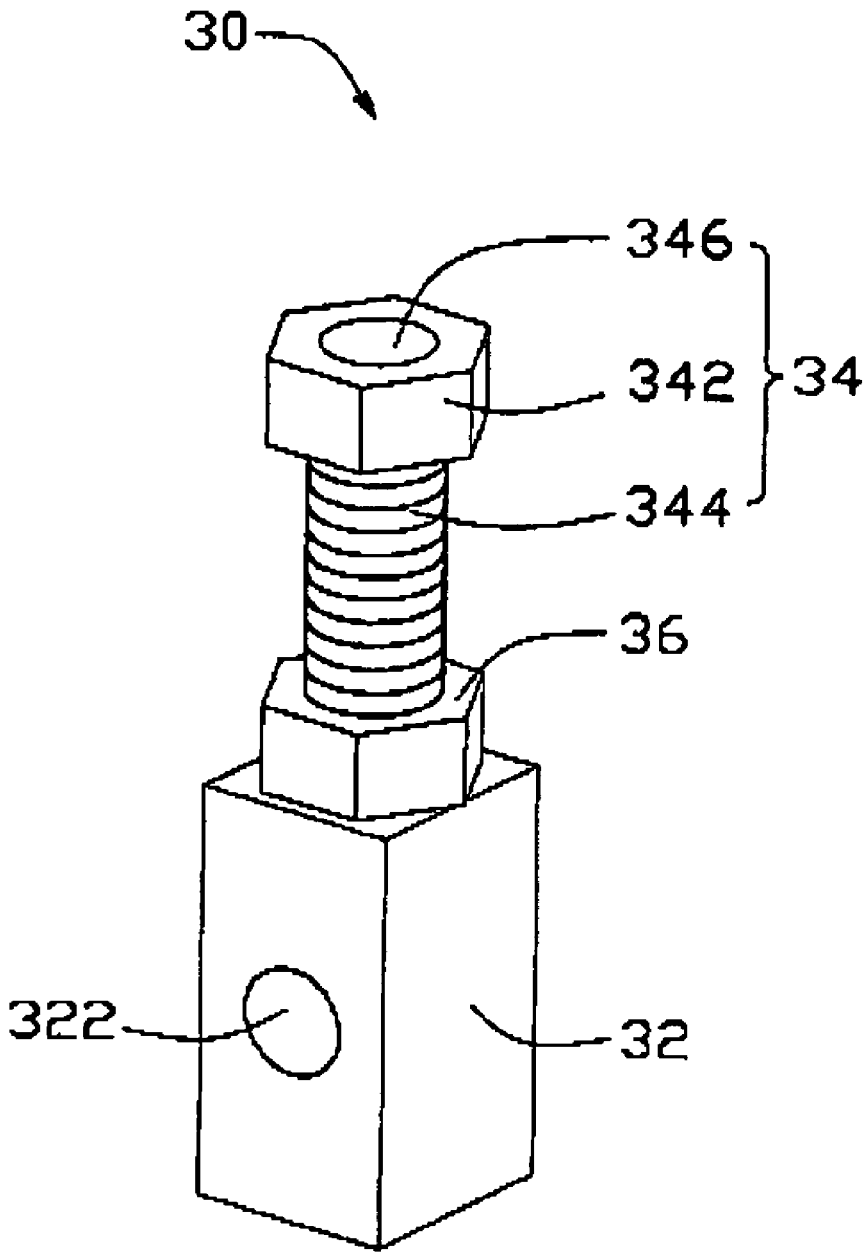
FIG. 3 is an enlarged view of a post of the printing apparatus shown in FIG. 1.

Also referring to FIG. 3, each post 30 includes a pedestal member 32, a second bolt 34 mounted on the pedestal 32 and a nut 36 engaging with the second bolt 34. The pedestal member 32 is a prism shorter than the prism member 22 of the bracket 20. The pedestal member 32 defines a first connecting hole 322 in its side portion and a third thread hole (not labeled) in its top portion. The third thread hole communicates with the first connecting hole 322. The second bolt 34 includes a second head portion and a second thread portion 344 corresponding to the third thread hole. The second bolt 34 defines an adjusting hole 346 in a central portion of the head portion 342; the adjusting hole 346 extends along the axis of the second bolt 34 and runs through the second bolt 34. In this way, the adjusting hole 346 communicates with the first connecting hole 322 via the third thread hole when the second bolt 34 is screwed into the third thread hole. The nut 36 is, correspondingly, configured to be screwed the bolt 34.

Figure 4:
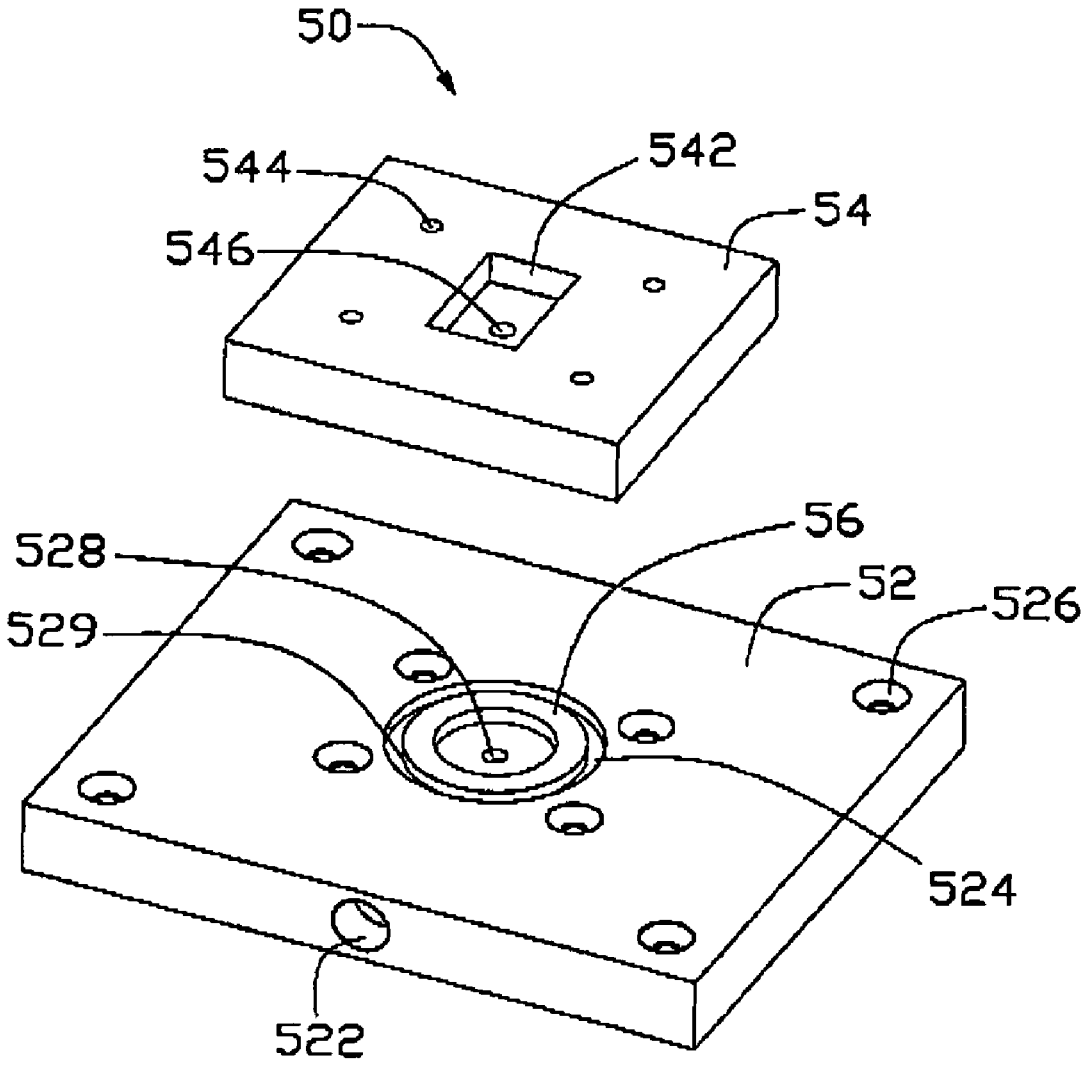
FIG. 4 is an exploded view of a base of a fixing mechanism of the printing apparatus shown in FIG. 1.

Referring to FIG. 1 and FIG. 4, the fixing mechanism 2 includes a base 50, an air pipe assembly 60 and an air pump 70 connected to the base 50 via the air pipe assembly 60. The base 50 includes an approximately rectangular locating board 52, a fixture 54 located on the locating board 52 and a gasket 56 received in the locating board 52. The locating board 52 defines a second connecting hole 522 in a side portion thereof, a suction recess 524 and a plurality of second locating holes 526. The second connecting hole 522 extends to a central portion of the locating board 52. The locating board 52 also defines a first air hole 528 in a central portion of a bottom of the suction recess 524 and a loop groove 529 surrounding the first air hole 528. The first air hole 528 communicates with the second connecting hole 522 at a central portion of the locating board 52. The second locating holes 526 are defined at each corner of the locating board 52. Some second locating holes 526 are configured for corresponding to the first locating holes defined in the carrying board 14. The gasket 56 is embedded in the loop groove 529.

The fixture 54 is an approximately rectangular board with a size smaller than that of the locating board 52. The fixture 54 defines a rectangular locating groove 542, four third locating holes 544, and a second air hole 546 therein. The locating groove 542 is defined in a central portion of the fixture 54. The third locating holes 544 are configured to be respectively adjacent at four corners of the locating groove 542 and correspond to four second locating holes 526. The second air hole 546 communicates with the locating groove 542 and corresponds to the first air hole 528 of the locating board 52.

The air pipe assembly 60 includes a first pipe 62, a second pipe 64 and a closeable third pipe 66. The first pipe 62, the second pipe 64 and the third pipe 66 are connected to each other and communicate with each other at a same joint, thus the air pipe assembly 60 is configured to be Y-shaped.

The silk-screen 3 is rectangular shaped and includes a large number of meshes (not labeled). The meshes can be used to form the designs/characters requiring to be printed to objects.

In assembly, the two brackets 20 are respectively fixed on two adjacent corners of the bottom board 12. The two posts 30 are respectively mounted on other two corners of the bottom board 12. The locating board 52 is placed on the carrying board 14 of the base 10, some mounting members (not shown) such as bolts are screwed into the second locating holes 526 which corresponds to the first locating holes, and then screwed into the first locating holes for fixing the locating board 52 on the carrying board 14. The fixture 54 is placed on the locating board 52, some mounting members (not shown) such as bolts are screwed into the third locating holes 544, and then screwed into the second locating holes 526 corresponding to the third locating holes 544 to fix the fixture 54 on the locating board 52, with the gasket 56 abutting the fixture 54.

The second air hole 546 is aligned with the first air hole 528, thus communicates with the second connecting hole 522. The first pipe 62 is connected to the air pump 70, the second pipe 64 communicates with the second connecting hole 522, and the third pipe 66 communicates with at least one first connecting hole 322. One side of the silk-screen 3 is fixed to the hanging members 264 of the hinge assembly 26 via gluing or soldering, and an opposite side of the silk-screen 3 is held by the second bolts 34 of the two posts 30. In this way, the silk-screen 3 covers the head portion 342 and the adjusting hole 346 of each bolt 34. The air pipe assembly 60 communicates with the first connecting hole 322 and the second connecting hole 522, and further communicates with the adjusting hole 346, the first air hole 528 and the second air hole 546 to form an air container (not labeled) communicating with the air pump 70. The silk-screen 3 can be rotated around the axle 263, and highness of the silk-screen 3 can be adjusted via the first bolts 24 and the second bolts 34.

In use, an object (not shown), such as paper, is placed into the locating groove 542. The silk-screen 3 is rotated to cover the object and close the adjusting holes 346. The air pump 70 is turned on to deflate air of the second connecting hole 522, the first air hole 528 and the second air hole 546. In this way, an air pressure in the air container is decreased, and the object is absorbed in the locating groove 542, thus the object can be conveniently printed. After printing, the covering silk-screen 3 is rotated and removed from the bolts 34 and the object. When the silk-screen 3 is removed from the bolts 34, the adjusting holes 346 are opened, allowing air to enter into the air container. The air pressure in the air container resumes, and the printed object can be removed.

Understandably, the locating groove 542 can be in other shapes. A location of the silk-screen 3 can be adjusted via the first bolts 24 and the second bolts 34 to adapt objects having different thickness. The third pipe 66 can also be opened or closed by other means, such as adjustable clamp to adjust the air pressure in the container. Accordingly, the adjusting holes 346 and the first connecting holes 322 can be omitted.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A printing apparatus, comprising:

a worktable including a base, a bracket and a post;

a silk-screen, one end of the silk-screen being rotatably connected to the bracket and another end of the silk-screen being held by the post; and a fixing mechanism including a base positioned on the worktable, a pump, and an air pipe assembly, the air pipe assembly including a first pipe, a second pipe, and a third pipe, the first pipe connected to the pump and communicating with the second pipe, the second pipe connected to the base of the fixing mechanism, and the third pipe connected to the post and communicating with the first pipe and the second pipe.

2. The printing apparatus as claimed in claim 1, wherein the base of the fixing mechanism includes a locating board, the locating board defines a connecting hole in its side portion and a suction recess communicating with the connecting hole.

3. The printing apparatus as claimed in claim 2, wherein the suction recess defines an air hole in a central portion of its bottom and a loop groove surrounding the air hole in its bottom, the air hole communicates with the connecting hole.

4. The printing apparatus as claimed in claim 3, wherein the base of the fixing mechanism includes a gasket, the gasket is embedded in the loop groove.

5. The printing apparatus as claimed in claim 1, wherein the bracket includes a prism member, the prism member defines an adjusting aperture in its side portion and a first thread hole in its top portion, and the first thread hole communicates with the adjusting aperture.

6. The printing apparatus as claimed in claim 5, wherein the bracket includes a hinge assembly, the silk-screen is rotatably connected to a first bolt via the hinge assembly.

7. The printing apparatus as claimed in claim 1, wherein the post includes a pedestal member and a second bolt, the pedestal member defines a first connecting hole, the second bolt defines an adjusting hole extending along its axis and communicating with the first connecting hole.

8. The printing apparatus as claimed in claim 7, wherein the third pipe is connected to the first connecting hole and the adjusting hole, and is opened or closed via the silk-screen.

* * * * *